United States Patent [19]

Reiling

[11] 4,449,321

[45] May 22, 1984

[54] CRIB TOY

[75] Inventor: Walter S. Reiling, Livingston, N.J.

[73] Assignee: Meritus Industries, Inc., Florham Park, N.J.

[21] Appl. No.: 452,813

[22] Filed: Dec. 23, 1982

[51] Int. Cl.[3] ..... A63H 5/00

[52] U.S. Cl. ..... 46/113; 46/212; 46/217

[58] Field of Search ..... 46/1 K, 1 R, 211, 212, 46/206, 113, 217

[56] References Cited

U.S. PATENT DOCUMENTS

| | | | |
|---|---|---|---|
| 669,500 | 3/1901 | Andrews . | |
| 1,386,258 | 8/1921 | Huth . | |
| 1,547,517 | 7/1925 | Neff | 46/217 X |
| 2,149,180 | 2/1939 | Muller | 46/212 |
| 2,172,416 | 9/1939 | Swenson | 46/213 |
| 2,443,622 | 6/1948 | Klint | 46/212 |
| 2,508,046 | 5/1950 | Smith | 74/378 |
| 2,560,739 | 7/1951 | Perez | 46/212 |
| 2,625,831 | 1/1953 | Saunders | 74/342 |
| 2,708,811 | 5/1955 | Crowder | 46/212 |
| 2,770,074 | 11/1956 | Jones et al. | 46/247 |
| 3,386,406 | 6/1968 | Tsunoda | 114/144 |
| 3,564,765 | 2/1971 | Stormon et al. | 46/206 |
| 3,613,302 | 10/1971 | Stoher | 46/202 |
| 3,965,612 | 6/1976 | Asano | 46/211 |
| 4,189,038 | 2/1980 | Hurst | 192/21 |
| 4,285,159 | 8/1981 | Bass et al. | 46/262 |

FOREIGN PATENT DOCUMENTS

| | | |
|---|---|---|
| 305133 | 10/1929 | United Kingdom. |
| 356567 | 9/1931 | United Kingdom. |

*Primary Examiner*—Robert A. Hafer
*Assistant Examiner*—Perry Knutson
*Attorney, Agent, or Firm*—Lerner, David, Littenberg, Krumholz & Mentlik

[57] ABSTRACT

A crib toy adapted for back and forth motion along a crib rail by operation of a reversing mechanism is described and illustrated. The reversing mechanism is constructed generally from a support plate spring biased between a first and second position. Journaled adjacent one edge of the support plate is a first and second gear for alternate engagement with a drive gear depending upon the position of the support plate. The support plate is reciprocally moved between the first and second position for respective engagement of the first and second gears with the drive gear by means of a single cam surface and cam follower. The engagement of the first gear with the drive gear causes the crib toy to move along the crib rail in one direction while engagement of the drive gear with the second gear causes movement in the opposite direction. An assembly is provided which further causes pivotal movement of certain parts of the crib toy to increase its play value.

18 Claims, 8 Drawing Figures

CRIB TOY

BACKGROUND OF THE INVENTION

The present invention relates in general to a crib toy and, more particularly, to a crib toy having a reversing mechanism for moving the crib toy along a crib rail alternately in a forward and then a reverse direction thereby enhancing its play value to an infant lying in a crib.

It is generally well known that the attention span of an infant is relatively short. As a result, crib toys which are immobile offer little entertainment value to an infant lying in a crib. To this end, there has been devised in the prior art a crib toy adapted for repetitive back and forth movement along a crib rail while playing a soothing melody. One such prior art crib toy is disclosed in U.S. Pat. No. 4,285,159. In accordance with this prior art crib toy, a reversing mechanism is housed within an outer shell in the shape of a train to cause its repetitive back and forth movement along the crib rail. This prior art reversing mechanism is constructed generally from a motor which rotates first and second cam surfaces at a first speed while rotating first and second cam followers at a second speed. The differential speed causes the cam followers to drive first and second gears into alternate engagement with an output roller to drive the crib toy along the crib rail in repetitive back and forth motion.

Another prior art reversing mechanism adapted for use in a ground operated toy vehicle is disclosed in U.S. Pat. No. 2,443,622. The reversing mechanism of this prior art toy vehicle is constructed generally from a cam follower in contact with the circumferential surface of a clutch cam. The cam follower is linked to a cradle pivoted by operation of the cam follower and clutch cam. Journaled to the lower end of the cradle is a drive gear which supports an axle having wheels at either end thereof for causing movement of the toy vehicle along the ground. The cradle is positioned behind and between a forward and reversing gear, which gears are journaled to a stationary member. As the cam causes pivotal movement of the cradle via the cam follower, the drive gear is alternately meshed with the forward and then reversing gears thereby causing the toy vehicle to be driven in repetitive back and forth motion by its wheels.

These prior art reversing mechanisms suffer from a number of notable disadvantages. For example, the reversing mechanism of the prior art crib toy requires an expensive and complicated pair of dual speed cam assemblies. Of a different nature, the reversing mechanism of the toy vehicle has its wheels journaled to the pivotable cradle. As a result, operation of the reversing mechanism causes the wheels to be laterally displaced each time the cradle is pivoted to effect repetitive back and forth motion. This arrangement, however, is not generally suitable for use with a crib toy which moves along a slender crib rail as a result of the disruption of the toy vehicle during the lateral displacement of its wheels. Accordingly, it can be appreciated that there is an unsolved need for an improved crib toy having a reversing mechanism to effect its stable movement along a crib rail alternately between a forward and reverse direction, in addition, to being economical to manufacture and of simple construction.

SUMMARY OF THE INVENTION

It is broadly an object of the present invention to provide a crib toy having a reversing mechanism which overcome or avoids one or more of the foregoing disadvantages resulting from the use of the above-mentioned prior art reversing mechanism and, which fulfills the specific requirements of such a reversing mechanism for use in a crib toy. Specifically, it is within the contemplation of one aspect of the present invention to provide a crib toy having a reversing mechanism which causes repetitive movement of the crib toy along a crib rail alternately between a forward and reverse direction.

A further object of the present invention is to provide a crib toy having a reversing mechanism which is easily integrated with a melody producing device.

A still further object of the present invention is to provide a crib toy having a reversing mechanism which is easily integrated with other components of the crib toy to provide separate movement of various parts of the crib toy to enhance its entertainment value to an infant, as well as increasing the infant's attention span.

A still further object of the present invention is to provide a crib toy having a reversing mechanism of improved design and construction over those of the prior art reversing mechanisms.

In accordance with one embodiment of the present invention, there is provided a crib toy comprising a reversing mechanism housed in an outer shell and moving means driven by the reversing mechanism for moving the crib toy along a crib rail, the reversing mechanism comprising first and second gears arranged on a support plate adjacent a portion of the moving means, rotating means for rotating the first and second gears, and pivoting means for pivoting the support plate to alternately engage the first and second gears with the moving means whereby the crib toy is driven along the crib rail in a forward and then reverse direction.

Still further in accordance with another aspect of the above embodiment, there is provided a crib toy comprising an outer shell, a reversing mechanism housed in the shell and moving means driven by the reversing mechanism for moving the crib toy along a crib rail in a reverse and then forward direction, the reversing mechanism comprising a support plate pivotly mounted within the shell between a first and second position, a reverse gear journaled to the support plate along one edge thereof adjacent one portion of the moving means, a pair of forward gears journaled to the support plate along the one edge thereof adjacent another portion of the moving means, the moving means fixedly journaled to the shell between the reverse and pair of forward gears, a drive gear rotated by a motor arranged within the shell for rotating the reverse and pair of forward gears, a cam and cam follower assembly housed in the shell for pivoting the support plate between the first and second positions to alternately engage the reverse gear and pair of forward gears with the moving means whereby the crib toy is driven along the crib rail in a reverse direction upon the reverse gear engaging the moving means and then in a forward direction upon one of the pair of forward gears engaging the moving means.

BRIEF DESCRIPTION OF THE DRAWINGS

The above description, as well as further objects, features and advantages of the present invention will be more fully understood by reference to the following detailed description of the presently preferred, but nonetheless illustrative, crib toy in accordance with the present invention when taken in conjunction with the accompanying drawings, wherein.

DETAILED DESCRIPTION

Figure 1:
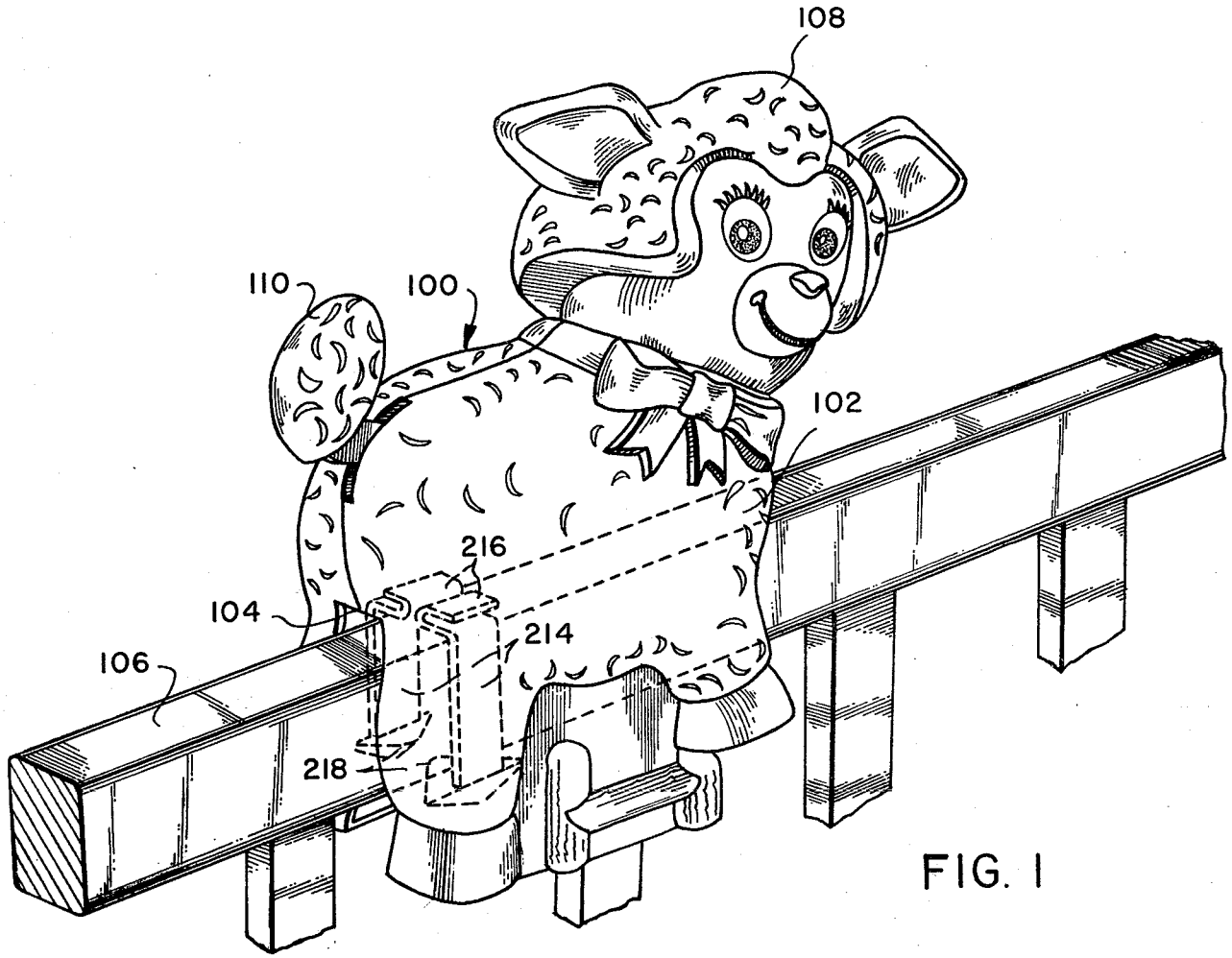
FIG. 1 is a perspective view showing the crib toy of the present invention positioned on a slender crib rail and adapted for movement in a repetitive forward and reverse direction.

Referring generally to the drawings in which like reference characters represent like elements, there is shown in FIG. 1 a perspective view of a crib toy 100 constructed from an outer shell 102 having an opening 104 arranged along the bottom thereof for positioning the crib toy over a crib rail 106. The crib toy 100 is shown in the form of a lamb having a movable head 108 and a movable tail 110. However, the outer shell 102 may be formed in the shape of other animals, figures and objects without departing from the present invention, as well as having other movable parts or sections.

Figure 2:
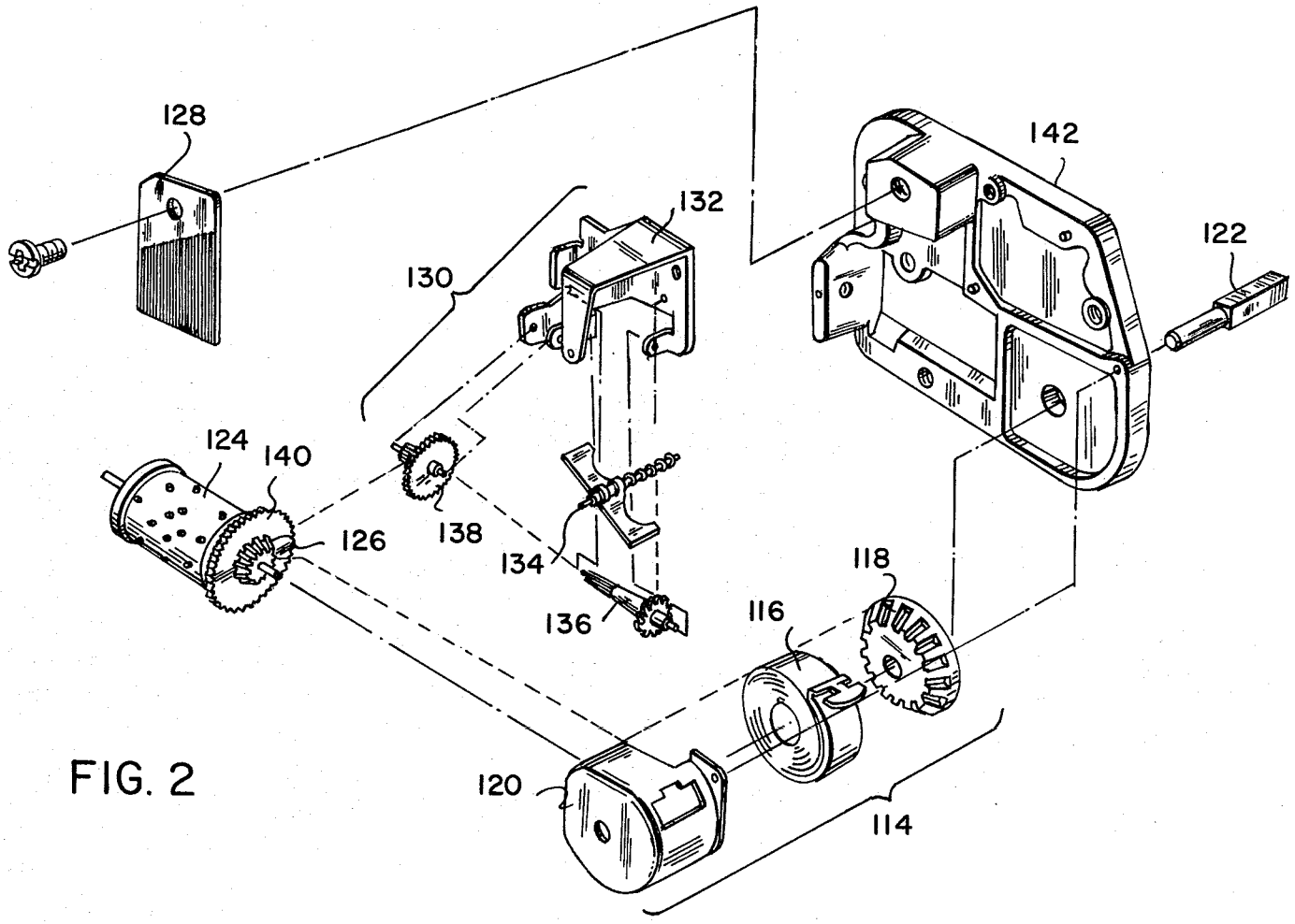
FIG. 2 is an exploded perspective view showing a melody producing device in unassembled form and adapted for use in the crib toy of the present invention.
Figure 3:
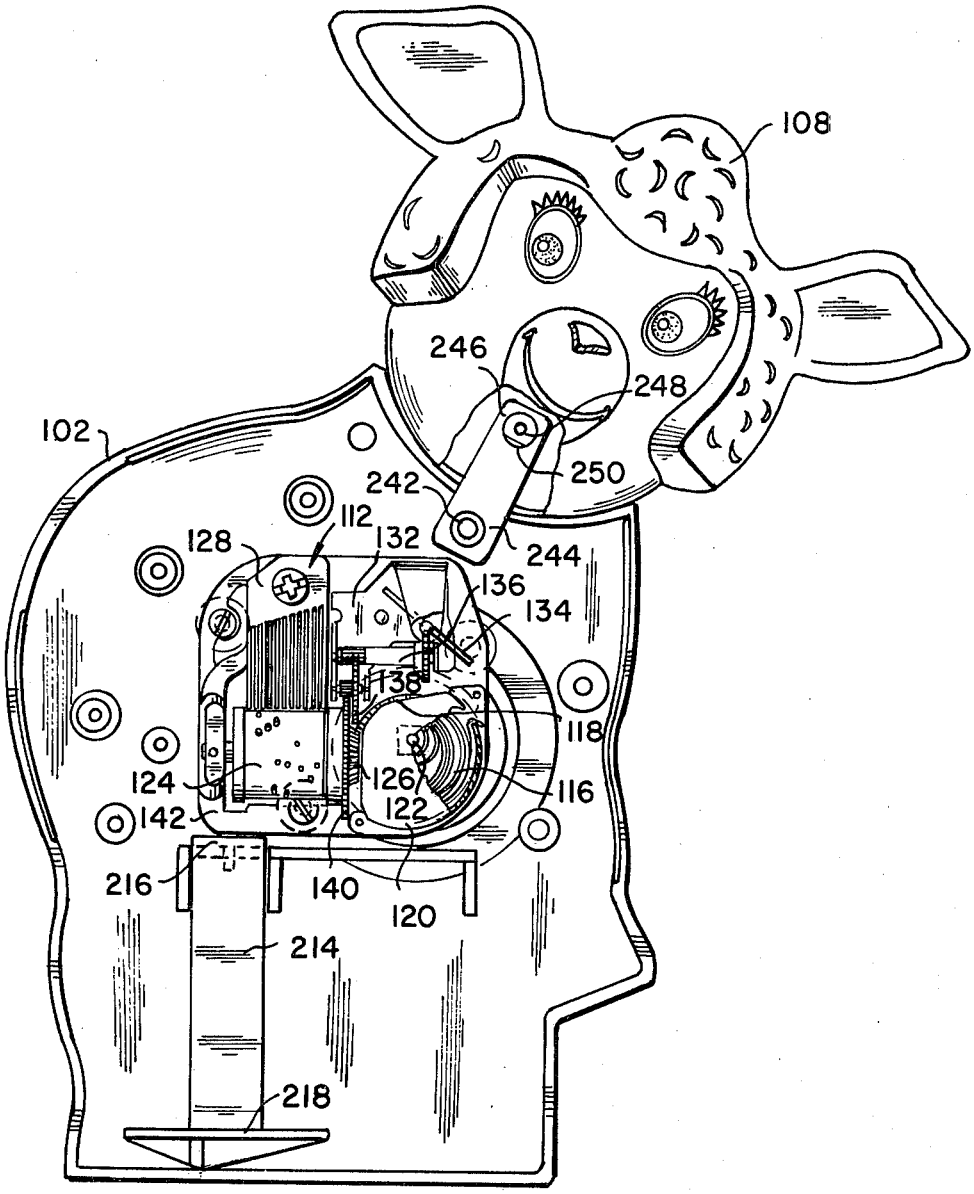
FIG. 3 is a front view of the crib toy of the present invention having a section removed for showing the melody producing device in assembled form.

Referring to FIGS. 2 and 3, the crib toy 100 is provided with a melody producing device 112. The melody producing device 112 is commercially available from a variety of sources, for example, Sankyo of Japan. Briefly, the melody producing device 112 as shown in FIG. 2 is constructed from a spring motor 114 comprising a wound spring 116, a beveled gear 118 and a housing 120, in addition to a spring winding pin 122. The beveled gear 118 rotates a pin drum 124 by engagement with beveled gear 126 for producing a musical melody by the sounding board 128. The speed of the pin drum 124 is regulated by a drag assembly 130 constructed from a mounting bracket 132 for supporting a fanned worm gear 134 and gear assemblies 136, 138. The drag assembly 130 is operatively connected to the pin drum 124 by gear 140 of the pin drum engaging gear assembly 138 of the drag assembly. The foregoing components of the melody producing device 112 are mounted to a support plate 142 and assembled as illustrated in FIG. 3 for producing a musical melody therefrom.

Figure 4:
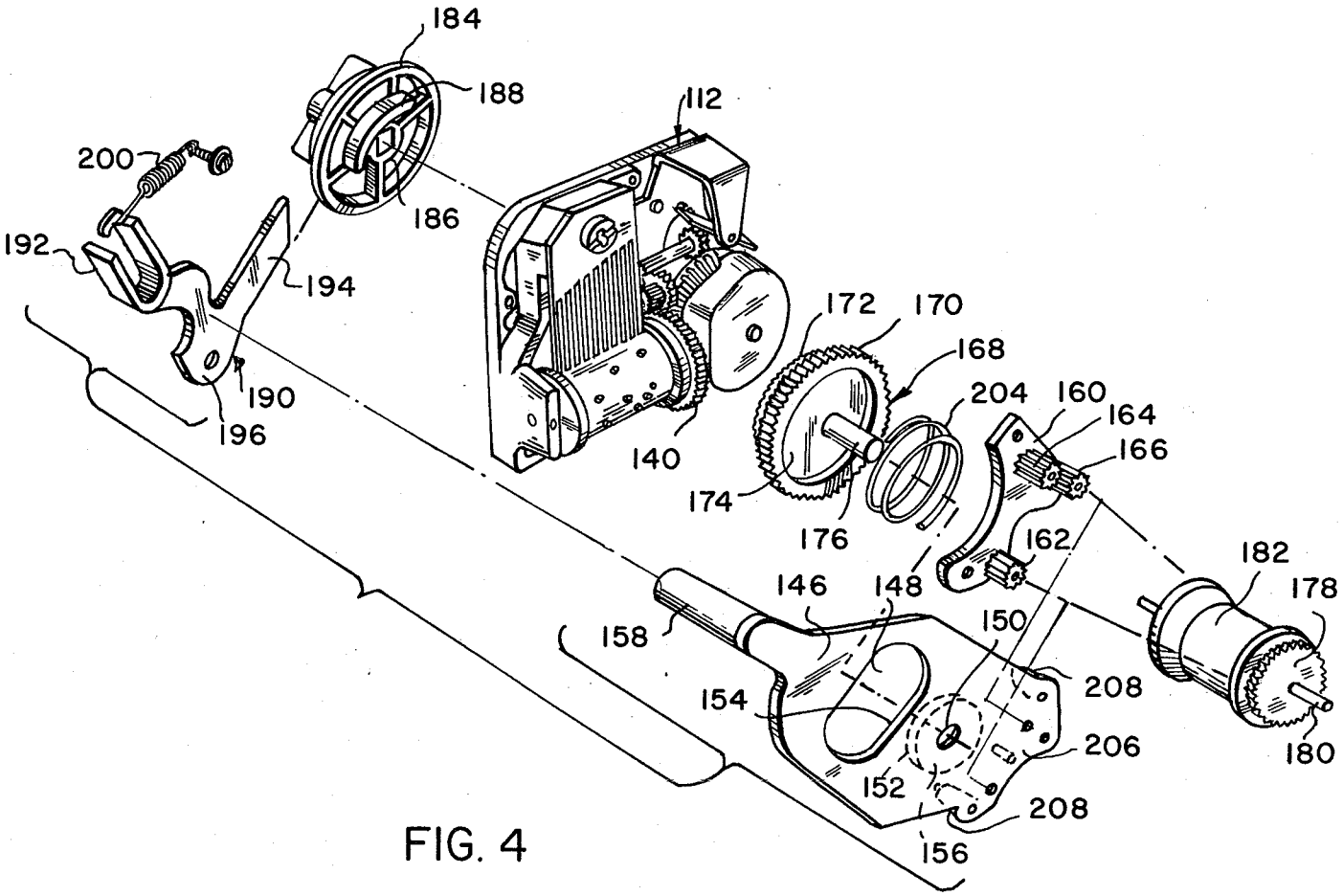
FIG. 4 is an exploded perspective view showing the reversing mechanism of the present invention in unassembled form.
Figure 5:
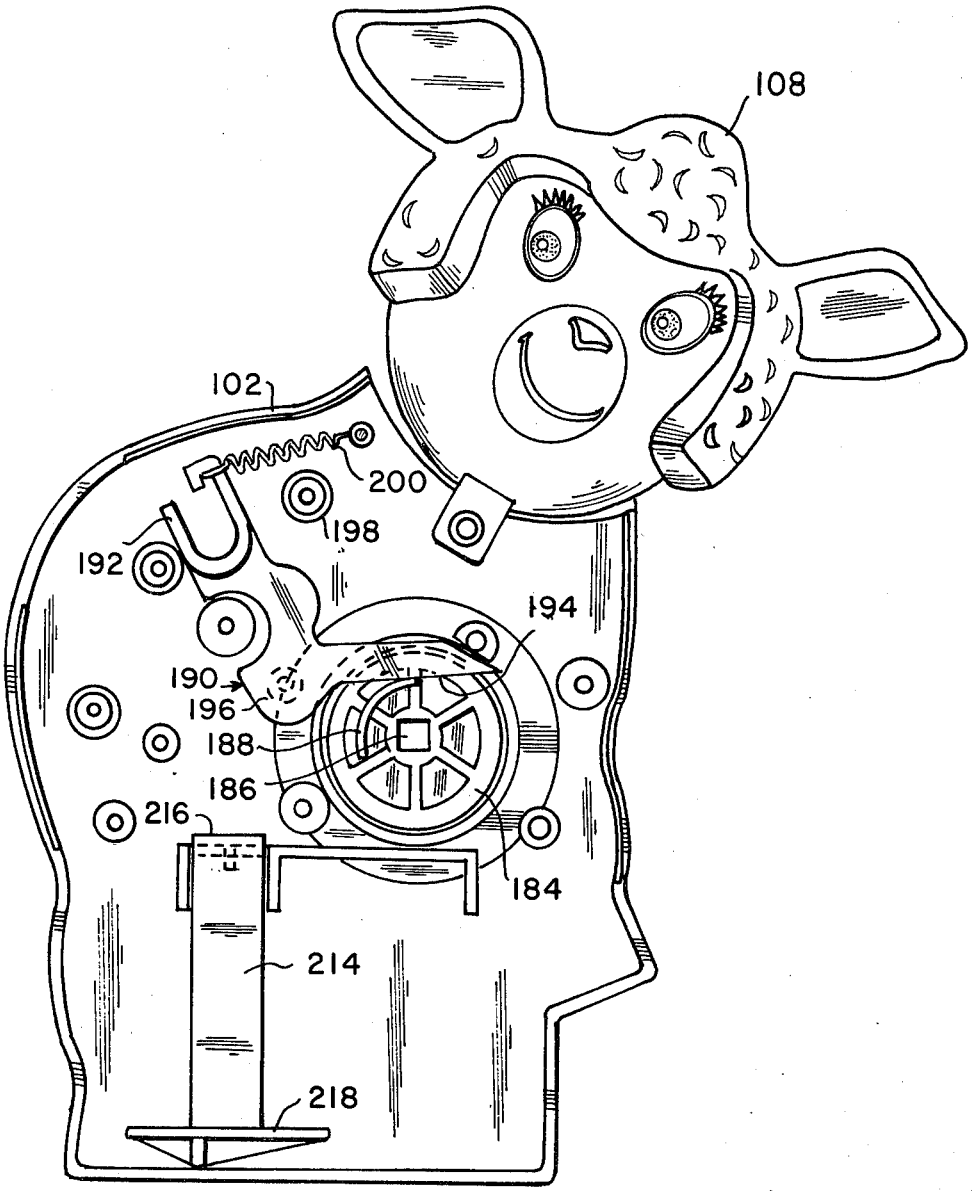
FIGS. 5 and 6 are front views of the crib toy in accordance with the present invention having a section removed for showing various components of the reversing mechanism in assembled form.
Figure 6:
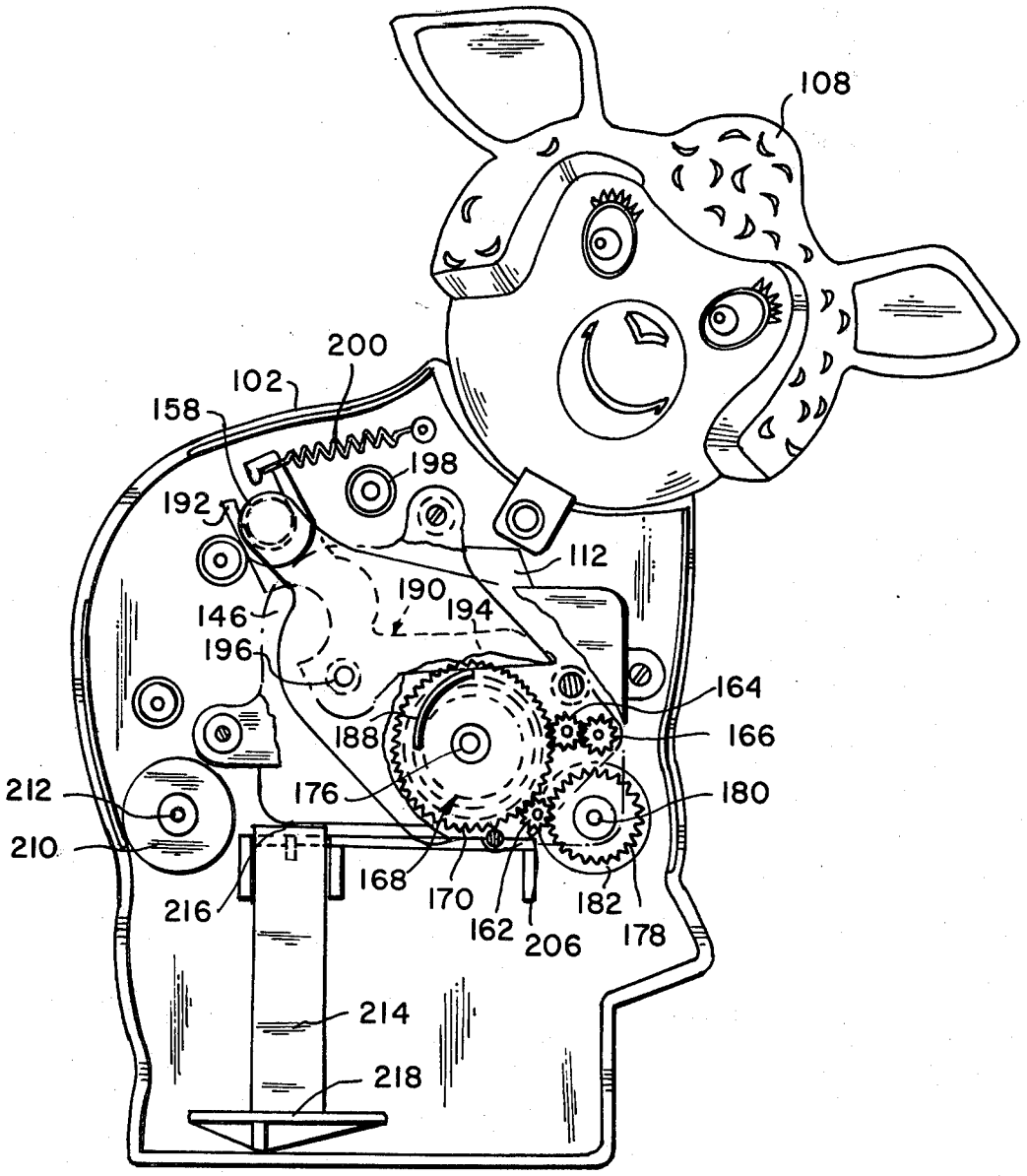

Referring now to FIGS. 4, 5 and 6, there will be described the construction and operation of a reversing mechanism 144 in accordance with the present invention. Specifically referring to FIG. 4, the reversing mechanism 144 is constructed from a support plate 146 having an elongated opening 148, a central opening 150 surrounded by a ridge 152 extending outwardly from the bottom surface 154 of the support plate to provide a cavity 156 and a rod 158 extending transversely from the bottom surface at one end of the support plate. A gear mounting plate 160 has journaled thereto a reverse pinion gear 162 and a pair of meshed forward pinion gears 164, 166. A crown gear 168 having teeth 170, 172 is provided with a cavity 174 from which a rod 176 extends outwardly at a central portion thereof. A drive gear 178 is secured to an axle 180 which extends through a first roller 182. A spring motor winding knob 184 is provided with a rectangular opening 186 partially surrounded by a cam 188 constructed in the form of a protruding ridge of arcuate shape. An L-shaped member 190 is constructed to include a U-shaped member 192 formed at the end of one leg and a cam follower 194 provided at the end of the other leg.

The assembly and operation of the reversing mechanism 144 will now be described with reference to FIGS. 5 and 6. The winding knob 184 is rotationally supported at a central portion of the outer shell 102 underlying the melody producing device 112 and is connected to the spring motor 114 by the rectangular end of the spring winding pin 122 extending into the rectangular opening 186 of the winding knob. The L-shaped member 190 is pivotally mounted at a heel portion 196 to the outer shell 102 adjacent the winding knob 184. The cam follower 194 of the L-shaped member 190 extends within the operative range of the cam 188 of the winding knob 184. The U-shaped member 192 of the L-shaped member 190 is positioned adjacent a stop pin 198 and is connected to a bias spring 200 for biasing the cam follower 194 into engagement with the cam 188 by pivotal movement of the L-shaped member about its heel portion 196.

Figure 8:
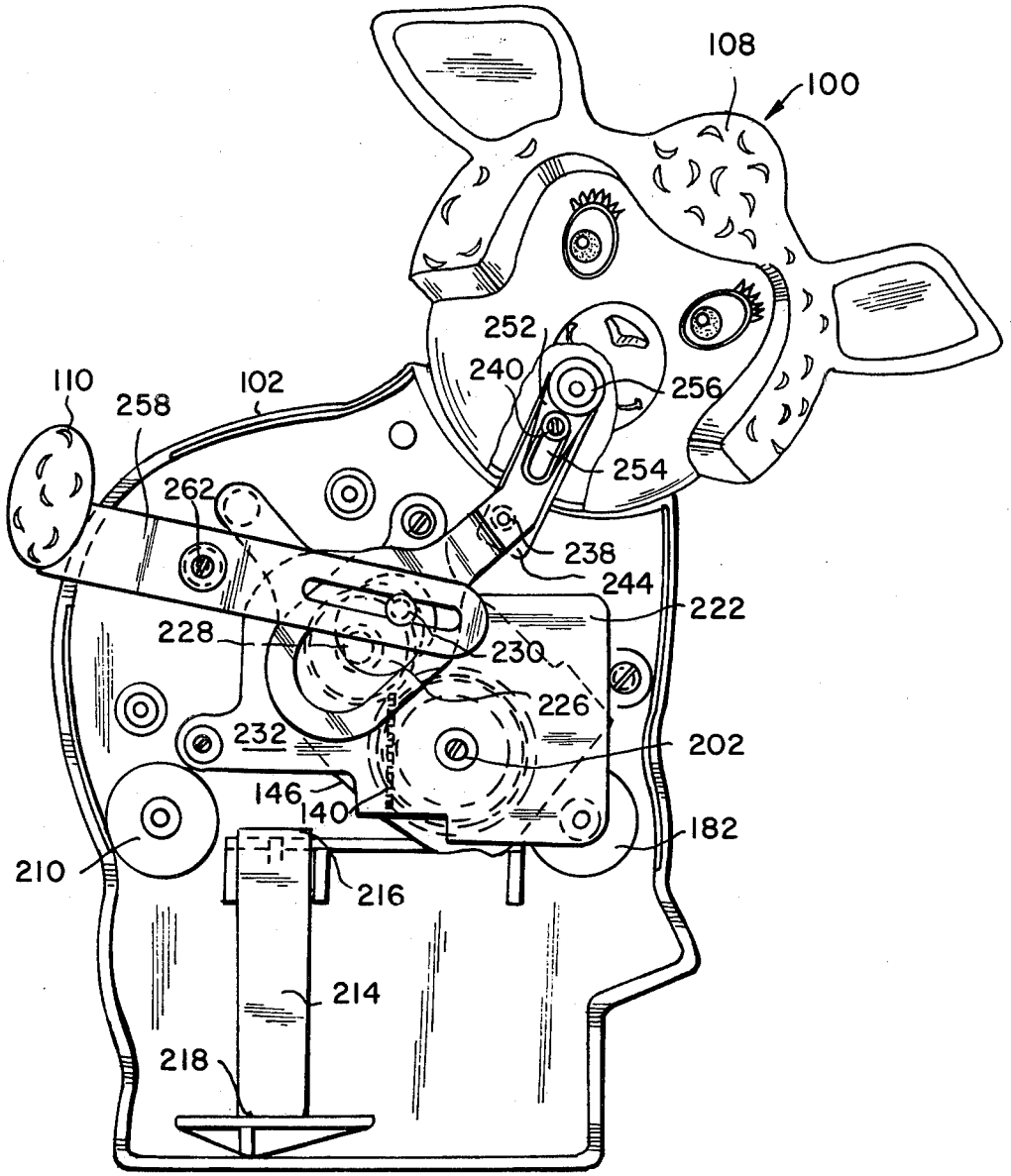
FIG. 8 is a front view of the crib toy in accordance with the present invention having a section removed for showing the assembly as shown in FIG. 7 in assembled form.

Referring to FIG. 6, the support plate 146 is pivotly secured within the outer shell 102 overlying the melody producing device 112 by the rod 176 of the crown gear 168 extending through the opening 150 of the support plate and being attached thereto by a loosely held screw and washer combination 202 as shown in FIG. 8. The ridge 152 of the support plate 146 surrounding the opening 150 extends into the cavity 174 of the crown gear 168 to provide an axle for the crown gear. A bias spring 204 (see FIG. 4) is positioned around the rod 176 of the crown gear 168 and within the cavities 156, 174 to maintain meshed contact between the teeth 172 of the crown gear with the gear 140 of the melody producing device. The pivotal movement of the support plate 146 about the rod 176 is achieved by the rod 158 being captured within the U-shaped member 192 of the L-shaped member 190 in a manner to be described hereinafter.

The gear mounting plate 160 is secured along one edge 206 of the support plate 146 by standoffs 208 (see FIG. 4) such that both the reverse pinion gear 162 and the forward pinion gear 164 mesh with the teeth 170 of the crown gear 168. A first roller 182 is journaled via axle 180 adjacent the crown gear 168 between the reverse pinion gear 162 and the forward pinion gear 166 for alternate engagement therewith upon pivotal movement of the support plate 146 in operation of the reversing mechanism 144 in accordance with the present invention. A second roller 210 having an axle 212 is journaled within the shell 102 in alignment with the first roller 182.

In operation, the crib toy is positioned over a crib rail 106 by the opening 104 in the outer shell 102. The crib toy 100 is supported on the top surface of the crib rail 106 by the first and second rollers 182, 210. To stabilize the crib toy 100 while on the crib rail 106, a pair of hook members 214 are pivotly secured within the outer shell 102. Each hook member 214 is pivotly secured at its upper end 216 to an internal portion of the outer shell 102. The lower ends of the hook members 214 are provided with a hook 218 which extends inward towards each other to project underneath the bottom surface of the crib rail 106 (see FIG. 1). The spaced relationship between the pair of hook members 214 provides an opening through which the crib rail 106 slides upon movement of the crib toy therealong. This opening, conforming generally to the size of the crib rail 106, stabilizes the crib toy 100 as it travels along the crib rail. The crib toy 100 is now ready to be driven along the crib rail 106 in a repetitive back and forth motion by operation of the reversing mechanism 144.

The spring motor 114 is energized by rotation of the winding knob 184. As shown in FIG. 2, the beveled gear 118 of the spring motor 144 causes rotation of the beveled gear 126 and gear 140 of the pin drum 124. Gear 140 of the pin drum 124 is meshed with the teeth 172 of the crown gear 168 to cause its rotation about the ridge 152 extending from the bottom surface 154 of the support plate 146 as shown in FIG. 4. The rotation of the crown 168 causes simultaneous rotation of the reverse pinion gear 162 and the forward pinion gears 164, 166 via teeth 170. As shown in FIG. 6, the crib toy 100 is adapted for movement along the crib rail 106 in a reverse direction. The winding knob 184 being rotated by the spring motor 114 causes the cam 188 to engage the cam follower 194 of the L-shaped member 190. This engagement of the cam 188 with the cam follower 194 causes the L-shaped member 190 to be pivoted about its heel 196 whereby the U-shaped member 192 is moved away from the stop 198 in opposition to the bias spring 200. As the U-shaped member 192 is moved away from the stop 198, the support plate 146 is pivoted about the rod 176 of the crown gear 168 into a first position by the rod 158 of the support plate being captured within the U-shaped member. The support plate 146 in its first position meshes the reverse pinion gear 162 with a portion of the drive gear 178 to cause rotation of the first roller 182 thereby moving the crib toy 100 along the crib rail 106 in a reverse direction.

Once the cam 188 has been rotated past the cam follower 194, the bias spring 200 pulls the U-shaped member 192 towards and against the stop 198 to pivot the L-shaped member 190 about its heel portion 196. The rod 158 of the support plate 146 being captured within the U-shaped member 192 causes the support plate to be pivoted about the rod 176 of the crown gear 168 into a second position (not shown). As apparent from FIG. 6, when the support plate 146 is pivoted about the rod 176 of the crown gear 168 into its second position as the U-shaped member 192 is pulled against the stop 198 via the bias spring 200, the reverse pinion gear 162 is disengaged from the drive gear 178 and the forward pinion gear 166 is meshed with another adjacent portion of the drive gear to cause forward rotation of the first roller 182 thereby driving the crib toy 100 along the crib rail 106 in a forward direction. Thus, it can be understood that the reversing mechanism 144 causes the crib toy 100 to be driven along a crib rail 106 alternately between a forward and reverse direction thereby increasing the attention span of an infant who is often lying docile in a crib.

In accordance with the present invention, there has thus far been described a crib toy 100 constructed from an outer shell 102, a reversing mechanism 144 housed in a shell and moving means 178, 182 driven by the reversing mechanism for moving the crib toy along a crib rail 106 in a forward and then reverse direction. The reversing mechanism 144 is constructed of a support plate 146 pivotly mounted within the shell 102 between a first and second position, a reverse gear 162 journaled to the support plate along one edge 206 adjacent one portion of the moving means 178, 182 a pair of forward gears 164, 166 journaled to the support plate along the one edge adjacent another portion of the moving means, the moving means fixedly journaled to the shell between the reverse and pair of forward gears, a drive gear 178 rotated by a motor 114 arranged within the shell for rotating the reverse and pair of forward gears, a cam 188 and cam follower 194 housed in the shell for pivoting the support plate between the first and second positions to alternately engage the reverse gear and pair of forward gears with the moving means whereby the crib toy is driven along the crib rail in a reverse direction upon the reverse gear engaging the moving means and then in a forward direction upon one of the pair of forward gears engaging the moving means.

Figure 7:
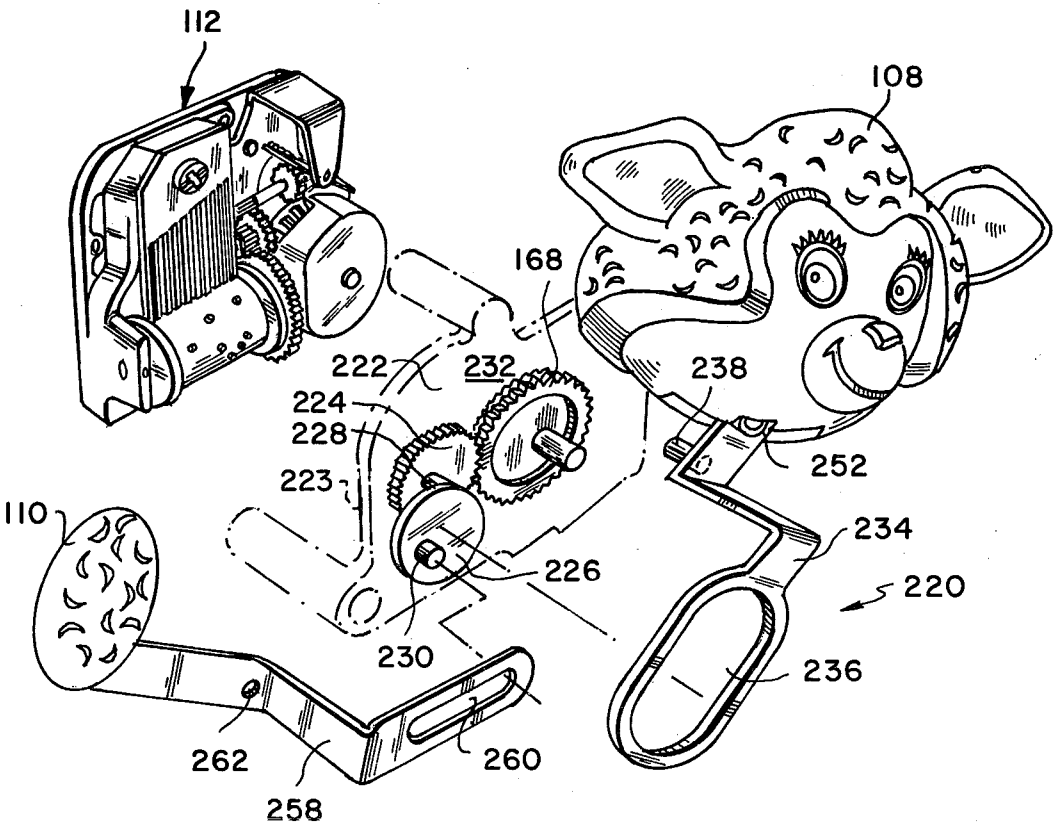
FIG. 7 is an exploded perspective view of an assembly adapted for moving certain parts of the outer shell of the crib toy in accordance with the present invention, namely a head and tail section.

Further in accordance with the present invention, to enhance the entertainment value of the crib toy 100 by increasing the attention span of the infant, an assembly 220 is provided for causing reciprocal movement of the head 108 and tail 110 of the crib toy. Referring to FIGS. 7 and 8, there is disclosed the construction of the assembly 220 for causing movement of the head 108 and tail 110 of the crib toy 100. A support plate 222 has journaled to its bottom surface 223 a gear 224 meshed with the teeth 170 of the crown gear 168. A cam 226 having offset projections 228, 230 is journaled to the upper surface 232 of the support plate 222 by the offset projection 228 extending through an opening (now shown) and being attached at its end to the gear 224 at the axis of rotation of the gear 224. The support plate 222 is secured to the outer shell 102 overlying the support plate 146 of the reversing mechanism 144. The cam 226 is rotated by the spring motor 114 via the gear 140, crown gear 168 and gear 224.

A head actuator 234 is constructed from a member having a slot-shaped opening 236 at one end, a centrally located downwardly projecting pin 238 and an upwardly projecting pin 240 located at the other end of the head actuator. As shown in FIG. 8, the head actuator 234 is positioned overlying the support plate 222 such that the cam 226 is received within the slot-shaped opening 236. The downwardly projecting pin 238 of the head actuator 234 is rotationally received within an opening 242 provided at one end of a support bar 244 as best shown in FIG. 3. The support bar 244 is secured at one end to the outer shell 102 of the crib toy 100 and extends into a central portion of the head 108. The head 108 is pivotly attached to the other end 246 of the support bar 244 by a rod 248. The rod 248 is secured to an internal portion of the head 108 and extends through an opening 250 within the other end of the support bar 244. The head actuator 234 is operatively connected to the rod 248 of the head 108 by an activator follower 252 (see FIG. 8) to cause pivotal movement of the head. The activator follower 252 has a slot-shaped opening 254 at one end thereof which receives the upwardly projecting pin 240 of the head actuator 234 and having its other end 256 connected to the rod 248 of the head 108 as it extends through the opening 250 of the support bar 244.

A tail actuator 258 is constructed from a member having a slot-shaped opening 260 provided at one end thereof, a central opening 262 to provide a pivot point for the tail actuator and the tail 110 being secured to the other end thereof. The slot-shaped opening 260 of the tail actuator 258 is positioned overlying the cam 226 and head actuator 234 to receive the offset projection 230 within the slot-shaped opening. The tail actuator 258 is pivotly connected to the outer shell 102 by a screw acting as a pivot point extending through the opening 262.

Briefly, the assembly 220 causes pivotal movement of the head 108 and tail 110 upon rotation of the cam 226. The elliptic rotational path of the cam 226 within the slot-shaped opening 236 of the head actuator 234 about the offset projection 228 causes the head actuator to pivot back and forth about the downwardly projecting pin 238. This pivotal movement of the head actuator 234 is transmitted to the head 108 by the upwardly projecting pin 240 of the head actuator being received in the slot-shaped opening 254 of the activator follower 252. In this regard, the activator follower 252 is pivoted about its other end 256 causing pivotal back and forth movement of the head 108 by rod 248. Likewise, the elliptic rotational path of the offset projection 230 of the cam 226 within the slot-shaped opening 260 of the tail actuator 258 causes the tail actuator to pivot about its pivot point at opening 262 thereby causing pivotal back and forth movement of the tail 110. Thus, the crib toy 100 of the present invention not only increases an infant's attention span by its back and forth motion along a crib rail, but by further providing for the pivotal movement of its head 108 and tail 110 while playing a soothing melody.

Although the invention herein has been described with reference to particular embodiments, it is to be understood that these embodiments are merely illustrative of the principals and application of the present invention. For example, although the head and tail of the crib toy has been described as being pivotable, where other forms of the crib toy other than a lamb are constructed, other parts thereof may be pivotable in a like manner to enhance the play value of such toy by increasing the attention span of an infant. It is therefore to be understood that numerous modifications may be made in the illustrative embodiments and that other arrangements may be devised without departing from the spirit and scope of the present invention as defined by the appended claims.

What is claimed is:

1. Crib toy comprising a reversing mechanism housed in an outer shell and moving means mounted in said shell and driven by said reversing mechanism for moving said crib toy along a crib rail, said reversing mechanism comprising first and second gears arranged on a support plate adjacent a portion of said moving means, said support plate being pivotally mounted within said shell between a first and second position, rotating means for rotating said first and second gears, and pivoting means for pivoting said support plate to alternately engage said first and second gears with said moving means whereby said crib toy is driven along said crib rail in a forward and then reverse direction, said pivoting means comprising a cam and cam follower, said cam being rotated by said rotating means and said cam follower having a member engaging a portion of said support plate.

2. Crib toy as set forth in claim 1 wherein said rotating means comprises a gear journaled to said support plate and a motor for causing rotation thereof.

3. Crib toy as set forth in claim 2 further including a melody producing device in operative association with said rotating means.

4. Crib toy as set forth in claim 1 further including an assembly for causing repetitive back and forth movement of a portion of said outer shell.

5. Crib toy as set forth in claim 4 wherein said assembly comprises a cam and an actuator having a slotted opening for receiving a portion of said cam, said cam being rotated by said rotating means.

6. Crib toy as set forth in claim 1 further including a pair of downwardly extending spaced members pivotly secured within said outer shell to receive therebetween said crib rail to stabilize said crib toy thereon.

7. Crib toy comprising an outer shell, a reversing mechanism housed in said shell and moving means mounted in said shell and driven by said reversing mechanism for moving said crib toy along a crib rail in a forward and then reverse direction, said reversing mechanism comprising a support plate pivotally mounted within said shell for pivoting between a first and second position, a reverse gear journaled to said support plate adjacent one portion of said moving means, a forward gear journaled to said support plate adjacent another portion of said moving means, rotating means for rotating said forward gear and said reverse gear, and pivoting means for pivoting said support plate between said first and second position to alternately engage said forward gear and said reverse gear with said moving means whereby said crib toy is driven along said crib rail in a forward and then reverse direction, said pivoting means comprising a cam and cam follower, said cam being rotated by said rotating means and said cam follower having a U-shaped member engaging a portion of said support plate.

8. Crib toy as set forth in claim 7 wherein said rotating means comprises a gear journaled to said support plate and a motor for causing rotation thereof.

9. Crib toy as set forth in claim 8 further including a melody producing device arranged with said shell in operative association with said gear and said motor.

10. Crib toy as set forth in claim 7 further including an assembly for causing repetitive back and forth movement of a portion of said outer shell.

11. Crib toy as set forth in claim 10 wherein said assembly comprises a cam and an actuator having a slot-shaped opening for receiving a portion of said cam, said cam being rotated by said rotating means.

12. Crib toy as set forth in claim 11 further including a pair of said actuators for causing repetitive back and forth movement of a tail and head portion of said outer shell.

13. Crib toy as set forth in claim 7 further including a pair of downwardly extending spaced members pivotly secured within said outer shell to receive therebetween said crib rail to stabilize said crib toy thereon.

14. Crib toy comprising an outer shell, a reversing mechanism housed in said shell and moving means mounted in said shell and driven by said reversing mechanism for moving said crib toy along a crib rail in a reverse and then a forward direction, said reversing mechanism comprising a support plate pivotally mounted within said shell for pivoting between a first and second position, a reverse gear journaled to said support plate along one edge thereof adjacent one portion of said moving means, a pair of forward gears journaled to said support plate along said one edge thereof adjacent another portion of said moving means, said moving means fixedly journaled to said shell between said reverse and pair of forward gears, a drive gear rotated by a motor arranged within said shell for rotating said reverse and pair of forward gears, a cam and a cam follower housed in said shell for pivoting said support plate between said first and second positions to alternately engage said reverse gear and said pair of forward gears with said moving means whereby said crib toy is driven along said crib rail in a reverse direction upon said reverse gear engaging said moving means and then in a forward direction upon one of said pair of forward gears engaging said moving means.

15. Crib toy as set forth in claim 14 further including a melody producing device in operative association with said drive gear.

16. Crib toy as set forth in claim 14 further including an assembly for causing repetitive back and forth movement of a portion of said outer shell.

17. Crib toy as set forth in claim 16 wherein said assembly comprises a cam and an actuator having a slot-shaped opening for receiving a portion of said cam, said cam being rotated by an intermediate gear engaged with said drive gear.

18. Crib toy as set forth in claim 14 further including a pair of downwardly extending spaced members pivotly secured within said outer shell to receive therebetween said crib rail to stabilize said crib toy thereon.

* * * * *